US009776849B2

(12) United States Patent
Diaz et al.

(10) Patent No.: US 9,776,849 B2
(45) Date of Patent: Oct. 3, 2017

(54) FLUID DISPENSING ASSEMBLY

(71) Applicants: Dennis Diaz, Coral Gables, FL (US); Magdiel Martinez, Coral Gables, FL (US)

(72) Inventors: Dennis Diaz, Coral Gables, FL (US); Magdiel Martinez, Coral Gables, FL (US)

( * ) Notice: Subject to any disclaimer, the term of this patent is extended or adjusted under 35 U.S.C. 154(b) by 122 days.

(21) Appl. No.: 14/707,105

(22) Filed: May 8, 2015

(65) Prior Publication Data

US 2016/0325981 A1 Nov. 10, 2016

(51) Int. Cl.

| | |
|---|---|
| ***B08B 17/00*** | (2006.01) |
| ***B67D 3/00*** | (2006.01) |
| ***B08B 9/027*** | (2006.01) |
| ***F24F 13/22*** | (2006.01) |

(52) U.S. Cl.

CPC ..... *B67D 3/0077* (2013.01); *B08B 9/027* (2013.01); *B08B 17/00* (2013.01); *F24F 13/222* (2013.01); *F24F 2221/22* (2013.01)

(58) Field of Classification Search

CPC ..... B08B 9/0321

See application file for complete search history.

(56) References Cited

U.S. PATENT DOCUMENTS

| | | | | |
|---|---|---|---|---|
| 2,266,288 | A | 12/1941 | Thompson | |
| 3,864,763 | A | 2/1975 | Spransy | |
| 4,063,317 | A | 12/1977 | Santone | |
| 4,388,741 | A | 6/1983 | Breon | |
| 5,004,025 | A | 4/1991 | Robbins | |
| 7,392,658 | B1 | 7/2008 | Hardy, III | |
| D682,715 | S | 5/2013 | Wang | |
| 2007/0056982 | A1* | 3/2007 | Webster | B65D 83/0463 221/256 |

FOREIGN PATENT DOCUMENTS

| | | |
|---|---|---|
| WO | WO2011139342 | 11/2011 |

* cited by examiner

*Primary Examiner* — Jason Ko

(57) ABSTRACT

A fluid dispensing assembly includes a dispenser that may be attached to an air conditioning unit. A container is provided to contain a liquid clog remover. The container is removably attached to the dispenser thereby facilitating the container to be fluidly coupled to the dispenser. A hose is fluidly coupled between the dispenser and a condensation drain on the air conditioning unit such that the liquid clog remover inhibits the condensation drain from becoming clogged.

11 Claims, 4 Drawing Sheets

76
80
54
56
72
62
64
66
80

58
18
28
28
26
48
16
12
16
22
20
46
44
50

FLUID DISPENSING ASSEMBLY

BACKGROUND OF THE DISCLOSURE

Field of the Disclosure

The disclosure relates to dispensing devices and more particularly pertains to a new dispensing device for dispensing a liquid clog remover into a condensation drain thereby preventing the condensation drain from becoming clogged.

SUMMARY OF THE DISCLOSURE

An embodiment of the disclosure meets the needs presented above by generally comprising a dispenser that may be attached to an air conditioning unit. A container is provided to contain a liquid clog remover. The container is removably attached to the dispenser thereby facilitating the container to be fluidly coupled to the dispenser. A hose is fluidly coupled between the dispenser and a condensation drain on the air conditioning unit such that the liquid clog remover inhibits the condensation drain from becoming clogged.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
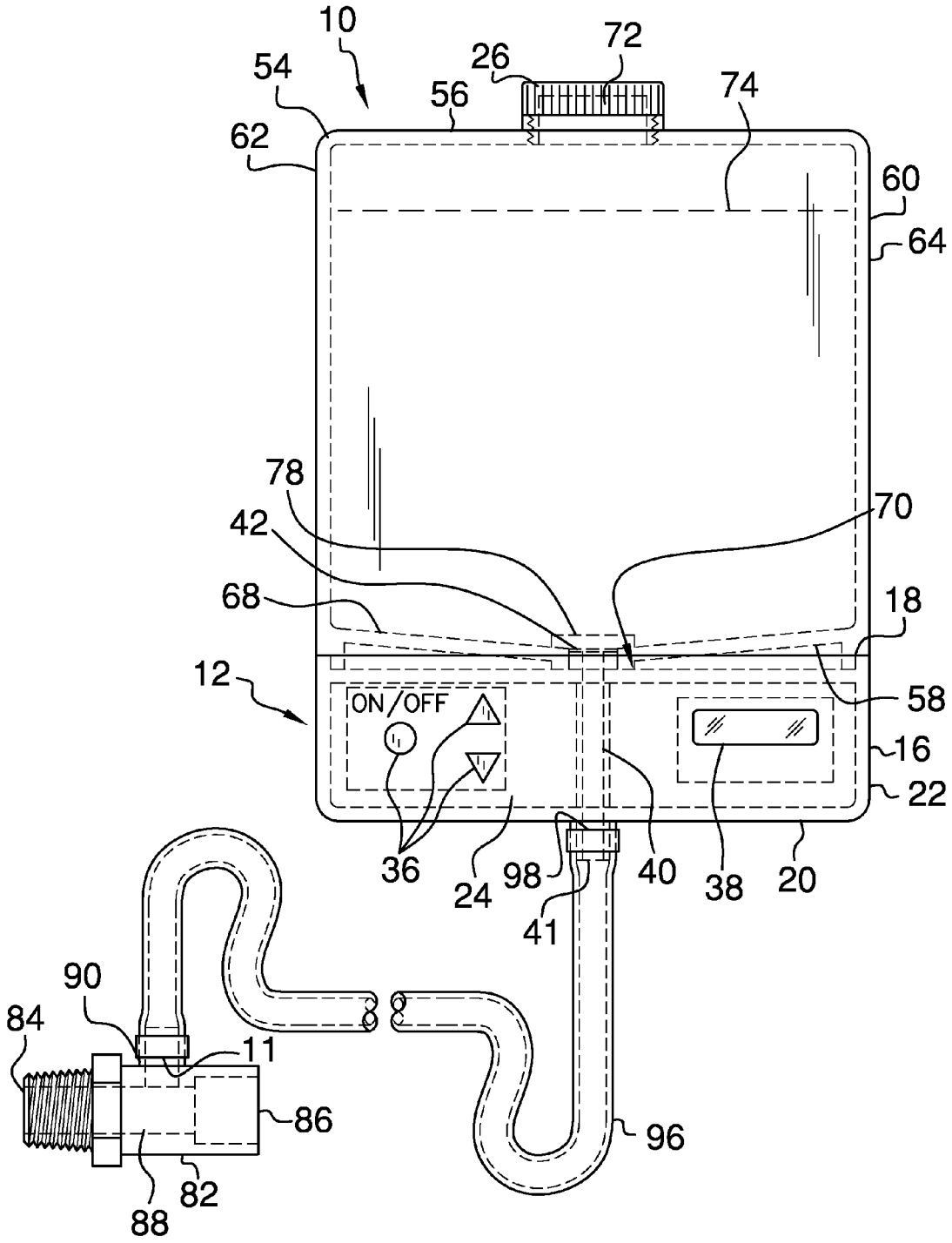
FIG. 1 is a front view of a fluid dispensing assembly according to an embodiment of the disclosure.
Figure 2:
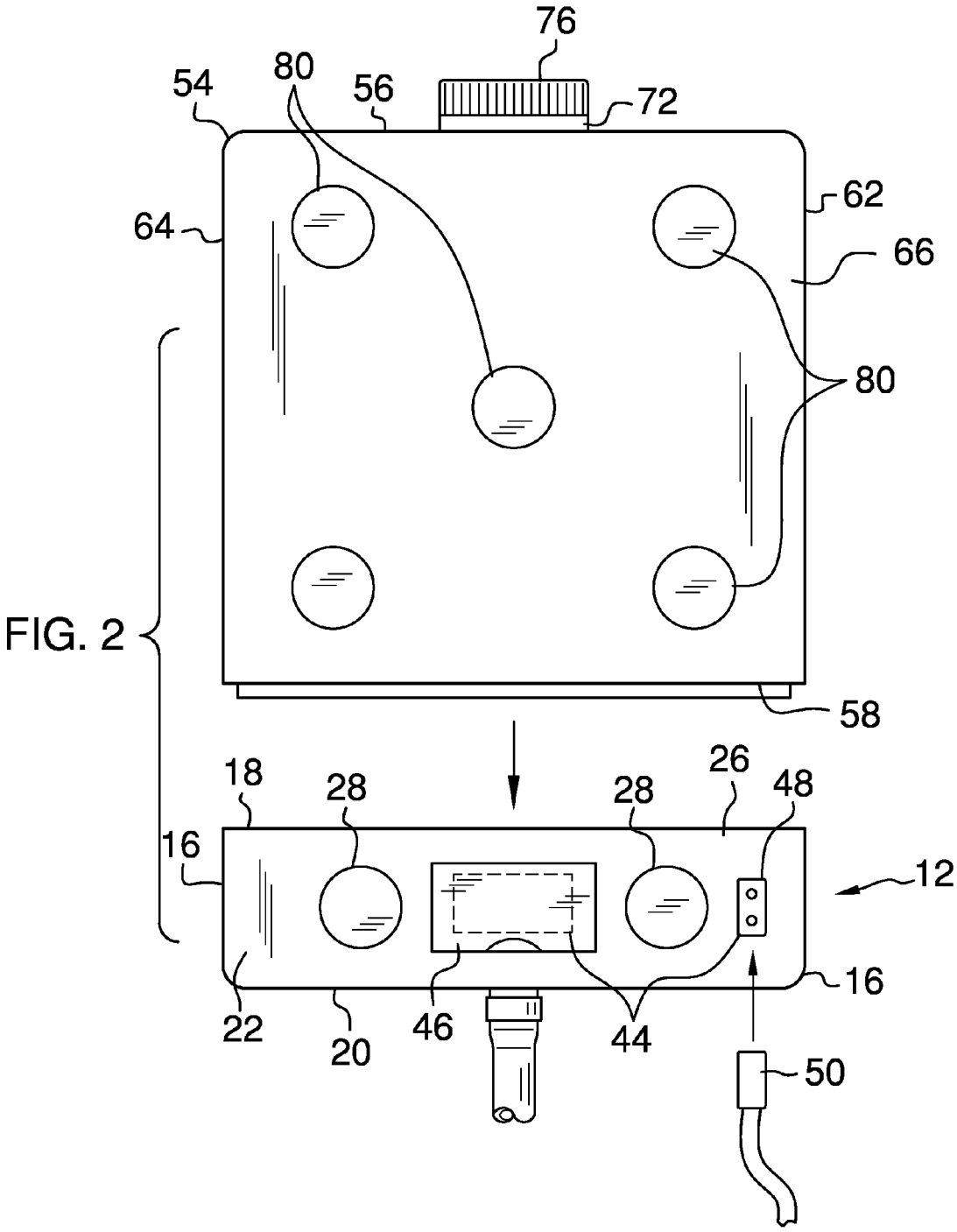
FIG. 2 is a back view of an embodiment of the disclosure.
Figure 3:
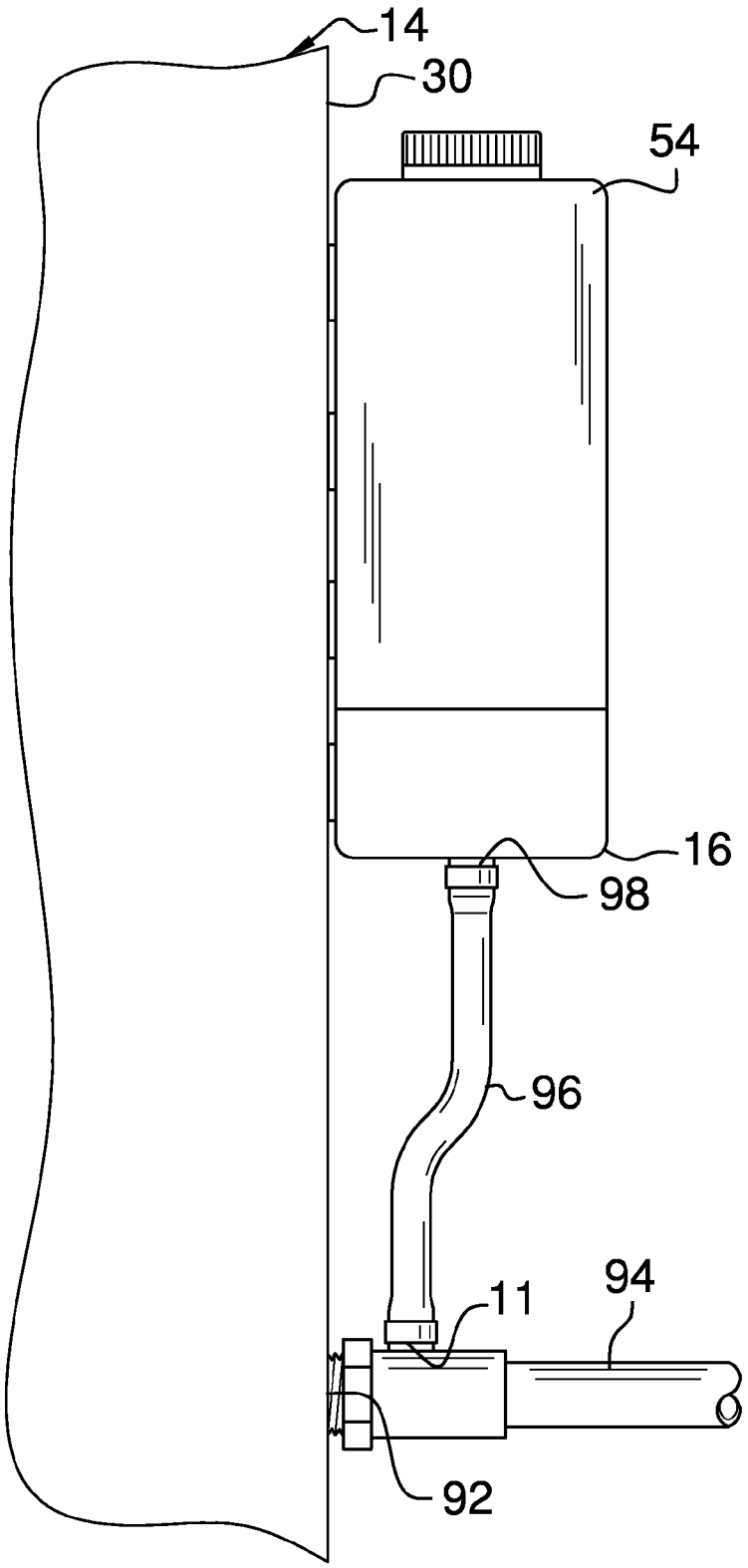
FIG. 3 is a perspective in-use view of an embodiment of the disclosure.
Figure 4:
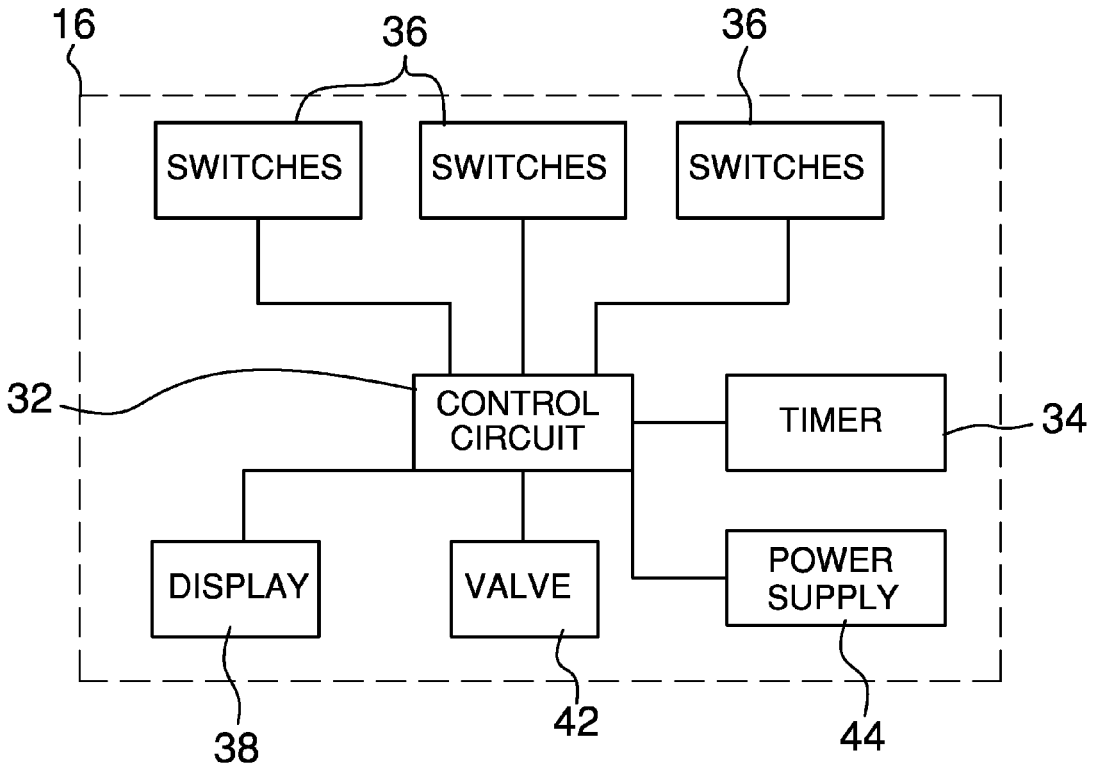
FIG. 4 is a schematic view of an embodiment of the disclosure.

With reference now to the drawings, and in particular to FIGS. 1 through 4 thereof, a new dispensing device embodying the principles and concepts of an embodiment of the disclosure and generally designated by the reference numeral 10 will be described.

As best illustrated in FIGS. 1 through 4, the fluid dispensing assembly 10 generally comprises a dispenser 12 that may be attached to an air conditioning unit 14. The air conditioning unit 14 may be an air handler for a central air system or other air conditioning unit utilized for the purposes of cooling a structure. The dispenser 12 comprises a mount 16 that has a top wall 18, a bottom wall 20 and a peripheral wall 22 extending between the top wall 18 and the bottom wall 20. The peripheral wall 22 has a front side 24 and a back side 26. A plurality of first fasteners 28 is provided and each of the first fasteners 28 is attached to the back side 26. Each of the first fasteners 28 may be comprised of a magnetic material. Thus, each of the first fasteners 28 magnetically engages an outer wall 30 of the air conditioning unit 14 such that the mount 16 is retained on the air conditioning unit 14.

A control circuit 32 is attached to the mount 16 and the control circuit 32 includes a timer 34. The timer 34 establishes a trigger time and the control circuit 32 may comprise an electronic processor or the like. The trigger time may be a duration of time ranging between approximately 10 calendar days and 21 calendar days. A plurality of switches 36 is provided and each of the switches 36 is attached to the front side 24 of the mount 16. Each of the switches 36 is electrically coupled to the control circuit 32. Each of the switches 36 is manipulated to actuate and de-actuate the control circuit 32 and to modify the trigger time between a minimum amount of time and a maximum amount of time. A display 38 is coupled to the front side 24 and the display 38 is electrically coupled to the control circuit 32. The display 38 displays the trigger time and the display 38 may comprise an LCD display or the like.

A conduit 40 is positioned within the mount 16 and the conduit 40 extends between the top wall 18 and the bottom wall 20. The conduit 40 extends downwardly through the bottom wall 20 and the conduit 40 has a distal end 41 with respect to the bottom wall 20. A valve 42 is coupled to the top wall 18 and the valve 42 is fluidly coupled to the conduit 40. The valve 42 is electrically coupled to the control circuit 32 and the valve 42 is in a closed position such that valve 42 fluidly restricts the conduit 40. The control circuit 32 actuates the valve 42 into an open position to coincide with the trigger time. The valve 42 may be an electrically actuated fluid valve or the like.

A power supply 44 is coupled to the mount 16 and the power supply 44 is electrically coupled to the control circuit 32. The power supply 44 comprises at least one battery 46 and a power socket 48. The power socket 48 is positioned on the back side 26 and the power socket 48 may be selectively electrically coupled to a power source 50. The power source 50 may comprise a power cord or the like. A battery cover 52 is removably coupled to the back side 26 and the at least one battery 52 is positioned beneath the battery cover 52.

A container 54 is provided that has a lower wall 56, an upper wall 58 and an exterior wall 60 extending between the lower wall 56 and the upper wall 58. The exterior wall 60 has a first lateral side 62, a second lateral side 64 and a back side 66. The lower wall 56 has an inside surface 68 and the lower wall 56 has an opening 70 extending therethrough. The container 54 has a nozzle 72 extending upwardly from the upper wall 58 and the nozzle 72 is open thereby facilitating the container 54 to be filled with a liquid clog remover 74. The liquid clog remover 74 may comprise a mixture of bleach and water, a mixture of vinegar and water or other mildly corrosive and antiseptic liquid mixture. The inside surface 68 of the lower wall 56 tapers downwardly toward the opening 70 from each of the first lateral side 62 and the second lateral side 64 thereby facilitating the liquid clog remover 74 to be urged toward the opening 70. A cap 76 is provided and the cap 76 threadably engages the nozzle 72 thereby facilitating the cap 76 to close the nozzle 72.

The container 54 is removably positioned on the mount 16 having the lower wall 56 abutting the top wall 18 of the mount 16 such that the opening 70 is aligned with the valve 42. Thus, the container 54 is fluidly coupled to the valve 42. A gasket 78 is positioned within the opening 70 to prevent the liquid clog remover 74 from escaping the container 54 when the container 54 is removed from the mount 16. The valve 42 extends through the gasket 78 when the container 54 is positioned on the mount 16. A plurality of second fasteners 80 is provided and each of the second fasteners 80 is attached to the back side 66 of the container 54. Each of the second fasteners 80 may be comprised of a magnetic material. Thus, each of the second fasteners 80 magnetically engages the outer wall 30 of the air conditioning unit 14 thereby retaining the container 54 on the outer wall 30. Additionally, the container 54 may be pre-filled with the liquid clog remover 74 and a new, pre-filled container 54 may be purchased once the liquid clog remover 74 is depleted.

A fitting 82 is provided that has a first end 84, a second end 86 and an outer wall 88 extending between the first end 84 and the second end 86. Each of the first end 84 and the second end 86 are open and the fitting 82 is substantially hollow. A nipple 90 extends away from the outer wall 88 of the fitting 82 and the nipple 90 is in fluidly coupled to the fitting 82. The first end 84 of the fitting 82 is fluidly coupled to a condensation outlet 92 on the air conditioning unit 14 and the second end 86 of the fitting 82 has a condensation drain 94 fluidly coupled thereto.

A hose 96 is provided that has a first end 98 and a second end 11. The first end 98 of the hose 96 insertably receives the distal end 41 of the conduit 40 such that the hose 96 is placed in fluid communication with the valve 42. The second end 11 of the hose 96 is fluidly coupled to the nipple 90 thereby facilitating the valve 42 to selectively release the liquid clog remover 74 into the condensation drain 94 at the trigger time. The amount of liquid clog remover 74 dispensed at the trigger time may be an amount ranging between approximately 4 liquid ounces and 6 liquid ounces. Thus, the liquid clog remover 74 inhibits the condensation drain 94 from becoming clogged.

In use, the first end 84 of the fitting 82 is fluidly attached to the condensation outlet 92 on the air conditioning unit 14 and the condensation drain 94 is fluidly attached to the second end 86 of the fitting 82. The mount 16 is magnetically attached to the outer wall 30 of the air conditioning unit 14 and the container 54 is positioned on the mount 16. The switches 36 are manipulated to establish the trigger time. The valve 42 releases the liquid clog remover 74 into the condensation drain 94 at the trigger time thereby inhibiting the condensation drain 94 from becoming clogged with algae or other organic material. The liquid clog remover 74 permits the condensation drain 94 to operate at full efficiency.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A fluid dispensing assembly configured to selectively release a clog remover into a condensation drain on an air conditioning unit thereby inhibiting the condensation drain from becoming clogged, said assembly comprising:

a dispenser configured to be attached to an air conditioning unit, said dispenser including a mount having a top wall, a bottom wall and a peripheral wall extending between said top wall and said bottom wall, said peripheral wall having a front side and a back side;

a container being configured to contain a liquid clog remover, said container being fluidly and removably attached to said dispenser, said container having a lower wall, an upper wall and an exterior wall extending between said lower wall and said upper wall, said exterior wall having a first lateral side, a second lateral side and a back side, said lower wall having an inside surface, said lower wall having an opening extending therethrough, said inside surface tapering downwardly toward said opening from each of said first lateral side and said second lateral side;

a hose fluidly coupled to said dispenser such that said hose is configured for extending to the condensation drain on the air conditioning unit such that the liquid clog remover is delivered to the condensation drain and inhibits the condensation drain from becoming clogged;

a plurality of first fasteners, each of said first fasteners being attached to said back side of said mount wherein each of said fasteners is configured to magnetically engage an outer wall of the air conditioning unit such that said mount is retained on the air conditioning unit; and a plurality of second fasteners, each of said second fasteners being attached to said back side of said container wherein each of said second fasteners is configured to magnetically engage an outer wall of the air conditioning unit, said back side of said container being coplanar with said back side of said mount when said container is coupled to said mount wherein said first fasteners are coplanar with said second fasteners.

2. The assembly according to claim 1, further comprising a control circuit being attached to said mount, said control circuit including a timer, said timer establishing a trigger time.

3. The assembly according to claim 2, further comprising a plurality of switches, each of said switches being attached to said front side, each of said switched being electrically coupled to said control circuit, each of said switches being manipulated to actuate and de-actuate said control circuit and to modify said trigger time between a minimum amount of time and a maximum amount of time.

4. The assembly according to claim 3, further comprising a display being coupled to said front side, said display being electrically coupled to said control circuit, said display displaying said trigger time.

5. The assembly according to claim 1, further comprising a conduit being positioned within said mount, said conduit extending between said top wall and said bottom wall, said conduit extending downwardly through said bottom wall, said conduit having a distal end with respect to said bottom wall.

6. The assembly according to claim 5, further comprising a valve being coupled to said top wall, said valve being fluidly coupled to said conduit, said valve being electrically coupled to said control circuit, said valve being in a closed position such that valve fluidly restricts said conduit, said control circuit actuating said valve into an open position to coincide with said trigger time.

7. The assembly according to claim 1, further comprising:

a control circuit; and a power supply being coupled to said mount, said power supply being electrically coupled to said control circuit, said power supply comprising at least one battery and a power socket, said power socket being positioned on said back side, said power socket being configured to be selectively electrically coupled to a power source.

8. The assembly according to claim 1, further comprising:

said mount having a valve; and said container having a nozzle extending upwardly from said upper wall, said nozzle being open such that said nozzle is configured to fill said container with a liquid clog remover, said container being removably positioned on said mount having said lower wall abutting said top wall such that said opening is aligned with said valve thereby facilitating said container to be fluidly coupled to said valve.

9. The assembly according to claim 8, further comprising a gasket being positioned within said opening wherein said gasket is configured to prevent the liquid clog remover from escaping said container when said container is removed from said mount, said valve extending through said gasket when said container is positioned on said mount.

10. The assembly according to claim 1, further comprising:

a conduit having a distal end;

a valve fluid coupled to said conduit, said valve being positioned in an open position at a trigger time; and said hose has a first end and a second end, said first end insertably receiving said distal end of said conduit such that said hose is placed in fluid communication with said valve, said second end being configured to be fluidly coupled to the condensation drain on the air conditioning unit thereby facilitating said valve to selectively release the liquid clog remover into the condensation drain at said trigger time such that the liquid clog remover inhibits the condensation drain from becoming clogged.

11. A fluid dispensing assembly configured to selectively release a clog remover into a condensation drain on an air conditioning unit thereby inhibiting the condensation drain from becoming clogged, said assembly comprising:

a dispenser configured to be attached to an air conditioning unit, said dispenser comprising:

a mount having a top wall, a bottom wall and a peripheral wall extending between said top wall and said bottom wall, said peripheral wall having a front side and a back side, a plurality of first fasteners, each of said first fasteners being attached to said back side of said mount wherein each of said fasteners is configured to magnetically engage an outer wall of the air conditioning unit such that said mount is retained on the air conditioning unit, a control circuit being attached to said mount, said control circuit including a timer, said timer establishing a trigger time, a plurality of switches, each of said switches being attached to said front side, each of said switched being electrically coupled to said control circuit, each of said switches being manipulated to actuate and de-actuate said control circuit and to modify said trigger time between a minimum amount of time and a maximum amount of time, a display being coupled to said front side, said display being electrically coupled to said control circuit, said display displaying said trigger time, a conduit being positioned within said mount, said conduit extending between said top wall and said bottom wall, said conduit extending downwardly through said bottom wall, said conduit having a distal end with respect to said bottom wall, a valve being coupled to said top wall, said valve being fluidly coupled to said conduit, said valve being electrically coupled to said control circuit, said valve being in a closed position such that valve fluidly restricts said conduit, said control circuit actuating said valve into an open position to coincide with said trigger time, and a power supply being coupled to said mount, said power supply being electrically coupled to said control circuit, said power supply comprising at least one battery and a power socket, said power socket being positioned on said back side, said power socket being configured to be selectively electrically coupled to a power source;

a container having a lower wall, an upper wall and an exterior wall extending between said lower wall and said upper wall, said exterior wall having a first lateral side, a second lateral side and a back side, said lower wall having an inside surface, said lower wall having an opening extending therethrough, said inside surface tapering downwardly toward said opening from each of said first lateral side and said second lateral side, said container having a nozzle extending upwardly from said upper wall, said nozzle being open such that said nozzle is configured to fill said container with a liquid clog remover, said container being removably positioned on said mount having said lower wall abutting said top wall such that said opening is aligned with said valve thereby facilitating said container to be fluidly coupled to said valve;

a gasket being positioned within said opening wherein said gasket is configured to prevent the liquid clog remover from escaping said container when said container is removed from said mount, said valve extending through said gasket when said container is positioned on said mount;

a plurality of second fasteners, each of said second fasteners being attached to said back side of said container wherein each of said second fasteners is configured to magnetically engage the outer wall of the air conditioning unit, said back side of said container being coplanar with said back side of said mount when said container is coupled to said mount wherein said first fasteners are coplanar with said second fasteners; and a hose having a first end and a second end, said first end insertably receiving said distal end of said conduit such that said hose is placed in fluid communication with said valve, said second end being configured to be fluidly coupled to a condensation drain on the air conditioning unit thereby facilitating said valve to selectively release the liquid clog remover into the condensation drain at said trigger time such that the liquid clog remover inhibits the condensation drain from becoming clogged.

* * * * *